US005176600A

United States Patent [19]

Wilkinson

[11] Patent Number: 5,176,600

[45] Date of Patent: Jan. 5, 1993

[54] AEROBIC RESISTANCE EXERCISE GARMENT

[76] Inventor: William T. Wilkinson, 1717 Town Point Rd., Chesapeak City, Md. 21915

[21] Appl. No.: 746,900

[22] Filed: Aug. 19, 1991

[51] Int. Cl.[5] ..... A63B 21/02

[52] U.S. Cl. ..... 482/124; 482/122; 482/105

[58] Field of Search ..... 272/119, 139, 116, 135, 272/137; 2/69, 94, 78 C; 280/810

[56] References Cited

U.S. PATENT DOCUMENTS

| | | | |
|---|---|---|---|
| 1,178,165 | 4/1916 | Lupton, Jr. | 280/810 |
| 1,633,124 | 10/1925 | Noe | 272/137 |
| 3,759,510 | 9/1973 | Jackson, Jr. | 272/119 |
| 4,220,299 | 9/1980 | Motter | 280/810 |
| 4,273,328 | 6/1981 | Ozbey et al. | 272/137 |
| 5,033,123 | 7/1991 | Audet | 2/69 |

FOREIGN PATENT DOCUMENTS

| | | | |
|---|---|---|---|
| 1128084 | 7/1982 | Canada | 280/810 |

*Primary Examiner*—Richard J. Apley
*Assistant Examiner*—Lynne A. Reichard
*Attorney, Agent, or Firm*—Connoly & Hutz

[57] ABSTRACT

An aerobic resistance exercise garment includes leg or sleeve sections. Where sleeve sections are used a web is connected to the main portion of the garment. The garment and/or the sleeve and/or the web is made of a stretchable, elastic, resilient material. During the main exercise program where the arms of the user are being swung, resistance is encountered by the sleeves being connected to the garment when the arm swings away from the body causing the material to stretch. Where the garment includes leg portions a web may interconnect the leg portions to each other so as to offer resistance during the movement of the leg in an exercise program.

32 Claims, 7 Drawing Sheets

AEROBIC RESISTANCE EXERCISE GARMENT

BACKGROUND OF INVENTION

Aerobic exercise is becoming increasingly popular. There is particularly a trend to provide more aerobic low impact workouts in less time. Generally, this has been accomplished by either 1) exercising by a faster pace; 2) exercising for a longer period of time; 3) moving the body, arms and/or legs more vigorously while exercising; 4) using weights such as shoe, hand, wrist, dumbbells, ankles or weight vests on the belt; and 5) using resistance bands or cords for the arms.

It would be desirable if the main aerobic exercise could be enhanced by a supplemental exercise wherein resistance is encountered during the normal movement of the arms and/or legs while participating in the main exercise program.

SUMMARY OF INVENTION

An object of this invention is to provide a supplemental exercise program which can be used to provide resistance in an automatic manner as a result of the normal movement of the arms and legs during a main exercise program.

A further object of this invention is to provide an aerobic resistance exercise garment which is capable of providing the supplementary exercise to the main program.

A still further object of this invention is to provide such an exercise garment which requires minimal modifications to normal garment technology.

A still further object of this invention is to provide such an exercise garment which is capable of being modified to vary the degree of resistance encountered during the supplemental exercise program.

In accordance with this invention the exercise garment may be used for providing resistance to the normal arm and/or leg movement which results during a main aerobic program such as jogging, walking, step climbing, etc. Where it is intended to provide resistance to arm movement the garment would include a sleeve which would extend to at least about the elbow. A web would be connected to and span the sleeve and the main portion of the garment. The sleeve and/or web and/or garment would be made of an elastic material that is stretchable and resilient so that when an arm is moved away from the body resistance is encountered causing the material to stretch. The material would then tend to resume its normal unstretched condition a the arm moves back toward the body.

When it is desired to use the invention for applying resistance to leg movement the garment would include leg sections which are interconnected by a web. In this embodiment, at least one leg section and/or the web would be made of an elastic, stretchable, resilient material to offer resistance when the legs move away from each other. Alternatively, the web could interconnect a leg and the main portion of the garment.

The invention may be practiced by having the webs completely detachable so that the garment could function as an ordinary garment during non-exercise periods. Alternatively, the web may be permanently attached at one end and detachable at the other end so that during periods of non-use, the web could be fixed to the garment, such as being secured to the main portion of the garment, or being wrapped around a leg portion of the garment.

The garment may include pockets for the insertion of weights so as to offer further resistance during the exercise program.

THE DRAWINGS

DETAILED DESCRIPTION

Figure 1:
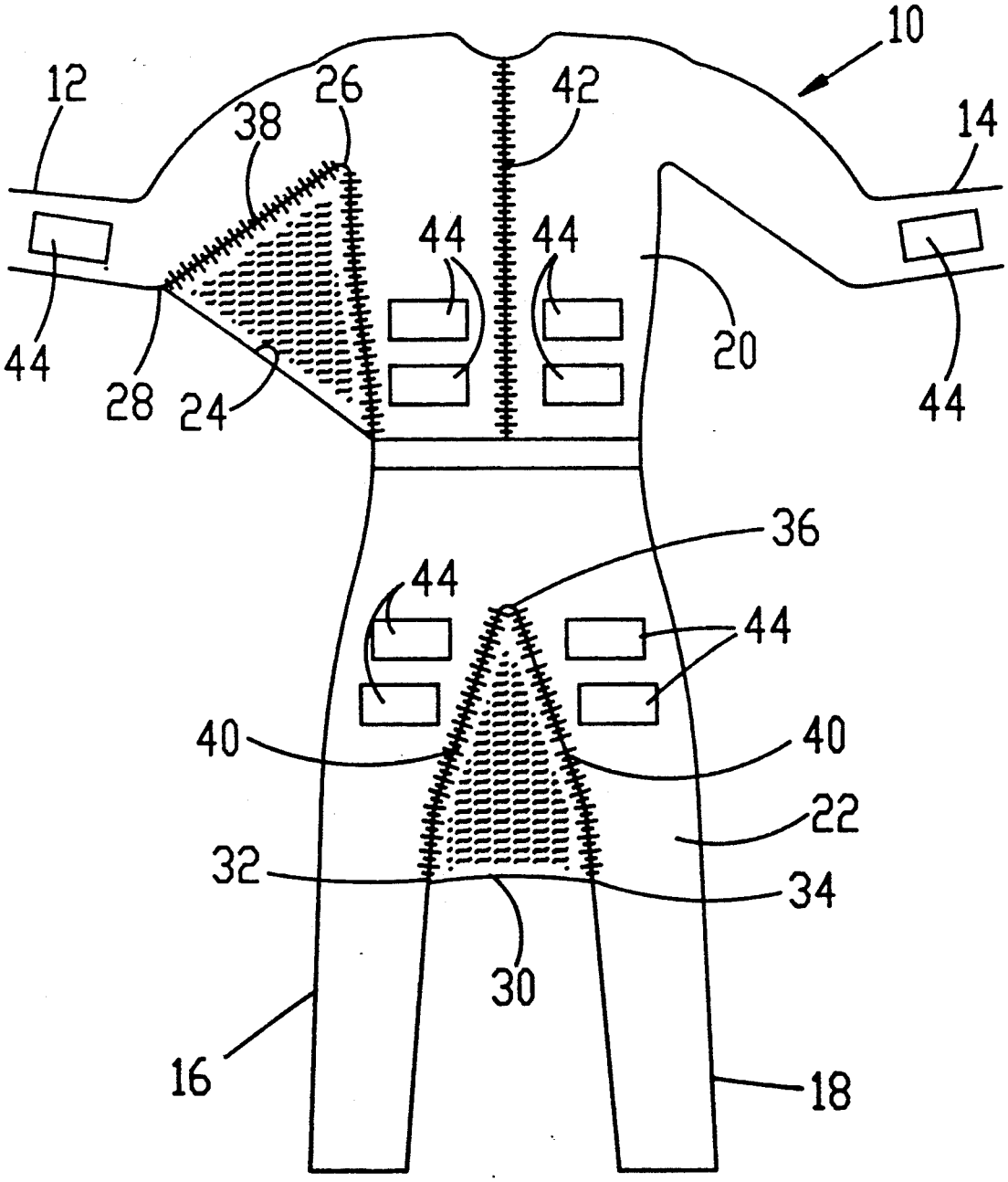
FIG. 1 is a front elevational view in accordance with one embodiment of this invention where the webs are completely detachable.

The present invention is based upon the recognition that an aerobic exercise program can be supplemented by taking into account that during conventional exercise programs there is arm and/or leg movement. Utilization is made of this movement to provide added resistance to supplement the exercise program. More particularly, the invention provides the added resistance by making use of garments such as clothing, sportswear, athletic wear, etc. which incorporates modified structures to provide this added resistance. In general, the modified structure is a web connected to the arm and/or legs portions of the garment to provide resistance when the arms move away from the body and/or the legs move away from each other. The specific form of webs is not critical and the invention may be practiced with the webs in various forms such as panels or cords. A further feature of the invention, which will later be described, is the utilization of pockets in the garment to provide for the addition of weights and thereby increase the resistance and aerobic value of the exercise.

The invention may be practiced with the garment itself taking various forms, such as an upper body garment which may be a top, shirt, sweater, jersey, tank top, tee shirt, coat or vest having sleeves for the arms. Additionally, the garment may be a lower body resistance garment, such as pants, shorts and sweatpants having leg portions. Further the garment may be a total body resistance garment, such as a one-piece suit or a multiple piece suit connected together and having sleeves and/or leg sections.

The level or amount of resistance can be fixed or can be adjusted or varied by the user by, for example, substituting a different form of web having different resistance characteristics. It is essential that at least one portion of the spanned garment must be elastic or made of a stretchable resilient material. The elastic portion may be the web and/or may be one or both portions of the garment to which the web is connected.

As previously noted, the web may take various forms, such as being a panel, strips, cords, strings, bands or a combination of such forms. The resistance structure or webs, may be permanently secured, completely detachable or partially detachable from the garment. The resistance structure or webs may join the arms to each other, to the torso, to a vest, to the waist or belt, or to the legs or feet. The resistance structure may join the legs to each other, to a torso, to a vest, to the waist or belt, or to the arms or hands.

In the preferred practice of the invention, a one or two piece garment is made of a suitable elastic, stretchable, resilient material, such as Lycra® which may be in the form of a complete body suit or a shirt or pants type garment that has reinforced elastic areas with panels joining the sleeves or arms to the torso and joining the legs to each other. The webs or panels would be shaped and located in accordance with the characteristic exercise motion which is intended to provide the desired resistance to the normal back and forth motion of the arms and legs during the main aerobic exercise program, such as walking, step climbing, jogging, running, or other forms of exercise, including swimming, cycling, yoga, dancing, ice or roller skating, aerobic warm-ups, etc. The panels or webs can have any suitable means of attachments, including zippers, snaps, hooks/loops so that the webs are detachable on one or more sides thereby permitting the user to engage the resistance when it is desired to supplement the main exercise program with more aerobic exercise. Additionally, the user may thereby adjust the level of aerobic exercise by the selective engagement of one or more panels. Alternatively, the user may completely disengage the webs or panels so that there is no supplement to the main exercise program.

The garment may also be provided with pockets so that weights could be added to further vary the load/resistance on the user. By adding such weights and resistance the user can thereby develop a progressive aerobic exercise program and the garment is thus adapted to all strengths, age and sex individuals. Further, the combination of adjustable resistance and weights allows the user to tune the exercise load to the correct feel or comfort and control the amount of exercise achieved in a given period of time.

FIG. 1 illustrates one form of the invention wherein an aerobic exercise garment 10 is shown as being a full body suit having arms 12,14 and legs 16,18 in addition to the main body portion which consists of an upper body section 20 and a lower body section 22.

In the embodiment shown in FIG. 1 garment 10 has a web 24 in the form of a panel secured to the torso or upper body portion 20 and also secured to the sleeve 12 from the armpit section 26 to the elbow 28. Although, not shown, the web 24 could extend beyond the elbow. The further down the sleeve that the panel or web 24 extends the greater will the resistance be affected by the normal full swinging movement of the arm toward and away from the body.

FIG. 1 also illustrates a second web 30 interconnecting leg portions 16 and 18 with the web 30 extending from the knee sections 32,34 to the crotch 36. In order to illustrate the possible variations of the invention the garment 10 of FIG. 1 does not include any web interconnecting the upper body portion 20 with the sleeve 14. It is to be understood, of course, that a web similar to web 24 may also be provided for sleeve 14.

In the illustrated embodiment, webs 24 and 30 are completely detachable by a zipper connection 38,40. It is to be understood that any other form of detachable connection may be used for the webs.

Body suit garment 10 may include any suitable means to permit the garment 10 to be put o or taken off the user. For the sake of illustration, a zipper 42 is shown to permit the garment 10 to be selectively open or closed so that the garment may be worn or removed.

As also shown in FIG. 1, a plurality of pockets 44 are provided at various locations on the garment 10 to permit weights to be inserted into the pockets thereby increasing the load or resistance for the user during the exercise program.

Figure 2:
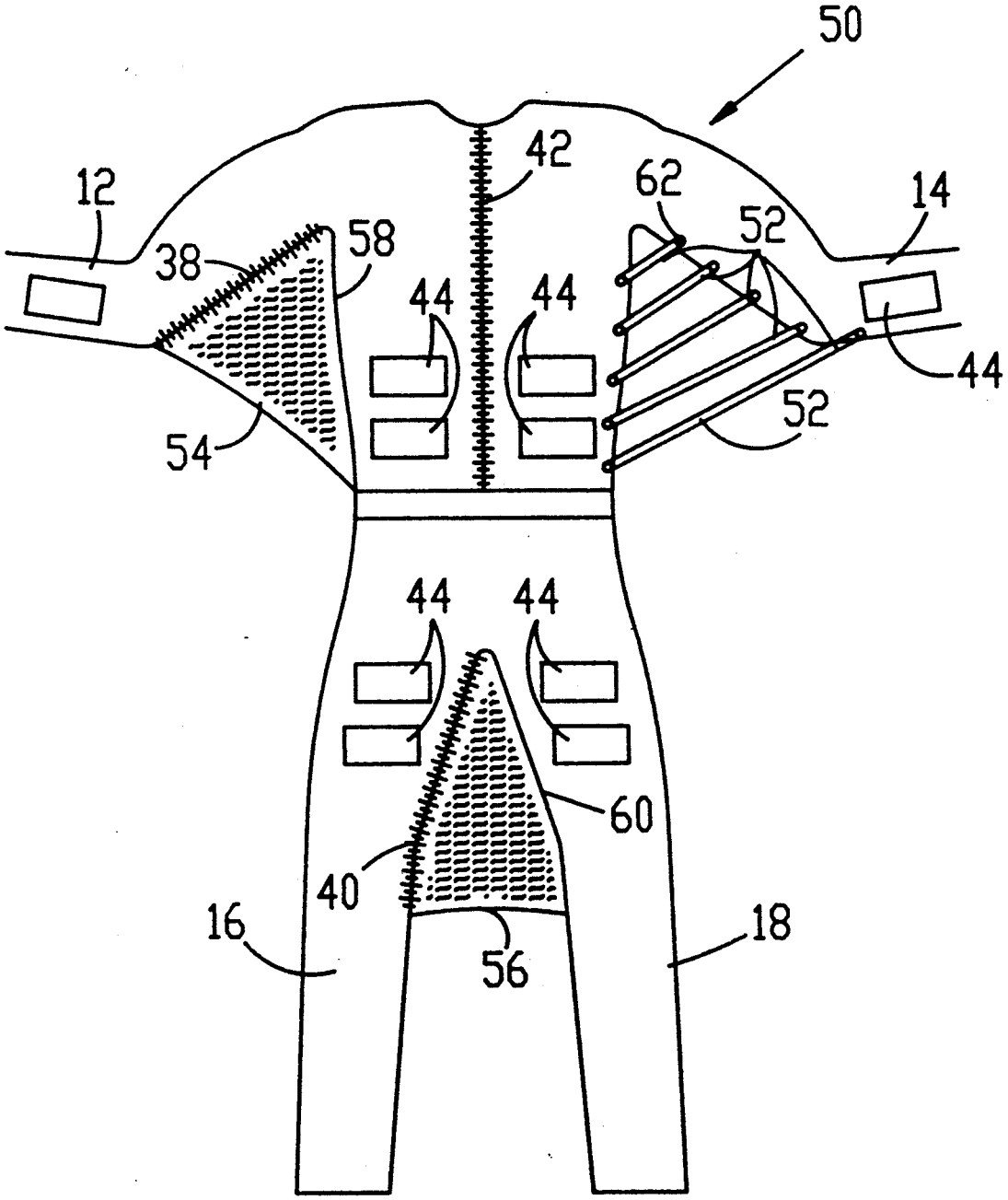
FIG. 2 is a front elevational view of a modified form of garment showing different forms of webs including webs partially detachable.

FIG. 2 illustrates a variation of the invention wherein the garment 50 is also in the form of a full body suit. In this variation, however, a further web in the form of a plurality of cords 52 is provided which spans the torso area 20 and sleeve 14. Webs 54 and 56 are also provided between the torso area and sleeve 12 and between the legs 16,18. Webs 54 and 56 differ from the webs shown in FIG. 1 in that one edge 58,60 of each web is permanently attached to the garment with a zipper 38,40 detachably connecting the other edge of the web to the garment. The cords 52 may be permanently attached or may be detachably connected by any suitable means, such as by the use of hooks or clips engaged in holes or eyelets 62.

Figure 6:
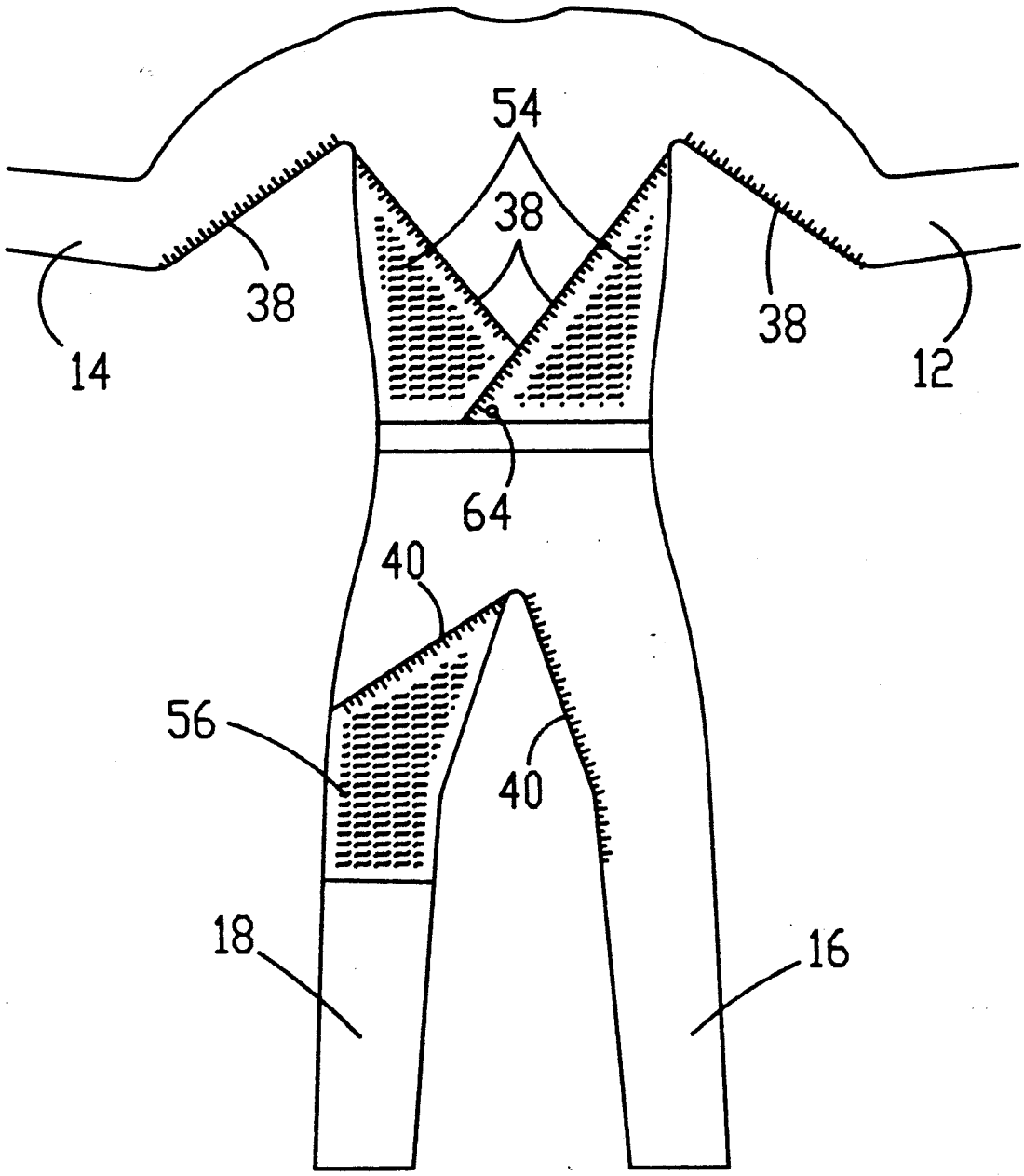
FIG. 6 is a rear elevational view of a garment of the type shown in FIG. 2, wherein the webs are in their stored condition.

Garmen 10 has the advantage that its completely detached webs may be completely removed so that the garment itself may function as an ordinary garment during periods of non exercise use. The garment 50 has the advantage of being able to partially detach the webs (thus preventing the webs from being lost or misplaced) which, however, would require some considerations for storing the webs while detached to webs 50 during non-exercise periods. As shown in FIG. 6 the storage may be accomplished by providing some form of detachable connection on the back portion of the garment so that during periods of non-use webs 54 may be crossed over each other and connected to the back of the garment while web 56 may be wrapped around the back of leg 18. It is noted that FIG. 6 differs from the version of FIG. 2 in that both arm webs are shown as being in the form of panels connected by zippers in FIG. 6. When the webs are folded back on the main portion of the garment for storage purposes, the webs may be detachably held in place in any suitable manner such as by a fastener 64, only one of which is shown for illustrative purposes in FIG. 6.

Figure 3:
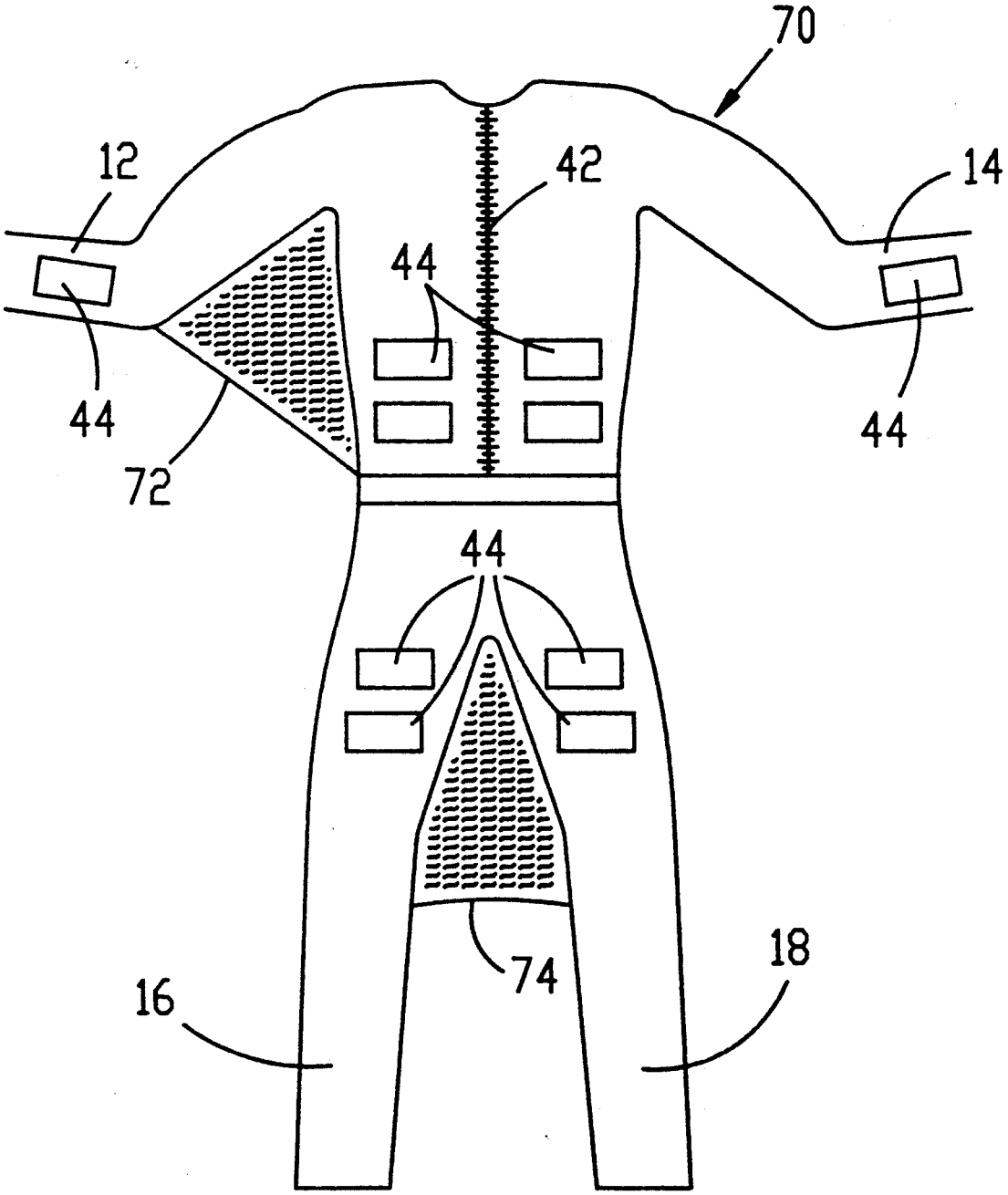
FIG. 3 is a front elevational view of yet another form of garment showing permanently attached webs.

FIG. 3 illustrates a further variation of the invention wherein the garment 70 is in the form of a one piece body suit having at least one sleeve connecting web 72 and a leg connecting web 74. In this embodiment the webs 72 and 74 are permanently attached. In this embodiment the suit 70 has the advantage of not having any storage problems by either completely removing the webs or by being required to partially detach the webs and then secure the webs to the garment. The disadvantage of course is that the garment 70 would generally be useful only as an exercise garment.

Figure 4:
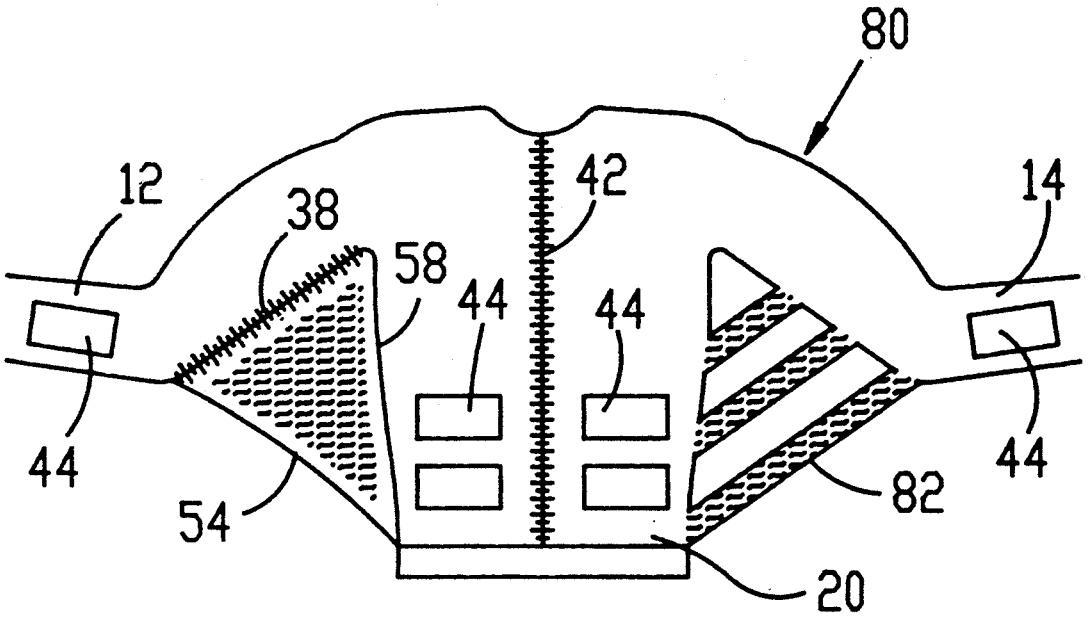
FIG. 4 is a front elevational view of a garment worn only on the upper portion of the body in accordance with this invention.

FIG. 4 illustrates a variation of the invention wherein the garment 80 is in the form of an upper body garment, rather than being a part of a complete suit. As illustrated, garment 80 includes a web 54 fixed along edge 58 and detachable along the opposite edge by means of zipper 38. The torso portion 20 of garment 80 is connected to sleeve 14 by a web in the form of permanent straps 82.

Figure 5:
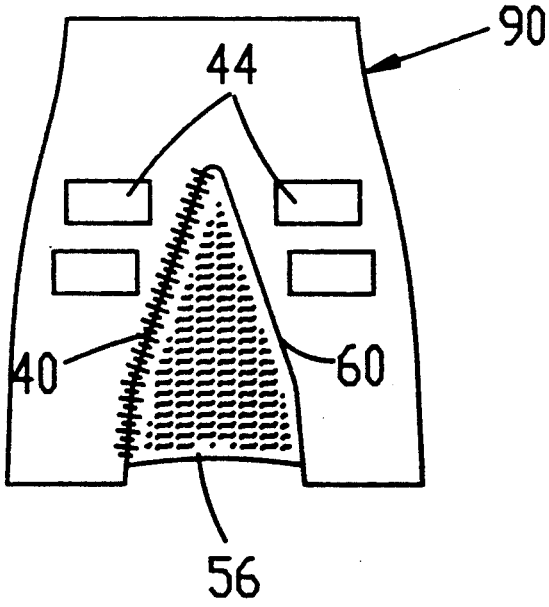
FIG. 5 is a front elevational view of a garment worn only on the lower portion of the body in accordance with this invention.

FIG. 5 illustrates a further variation wherein the garment 90 is in the form of pants. Garment 90 could be full length pants or short pants. The web illustrated in FIG. 5 is of the type shown in FIG. 2 wherein the web 56 is permanently attached at one edge 60 and detachable at the other edge by means of zipper 40.

Figure 7:
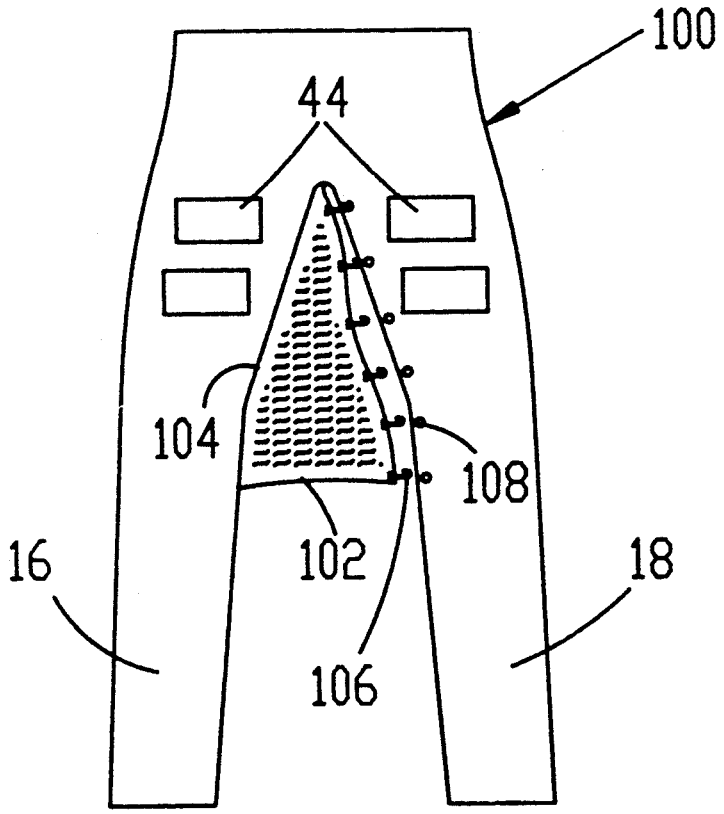
FIG. 7 is a front elevational view of yet another form of garment using a modified detaching means.

FIG. 7 shows a variation wherein the garment 100 is of full length form and includes a web 102 permanently attached along one edge 104 and detachably secured by means of hooks 106 selectively engaged in holes or eyelets 108.

Figure 8:
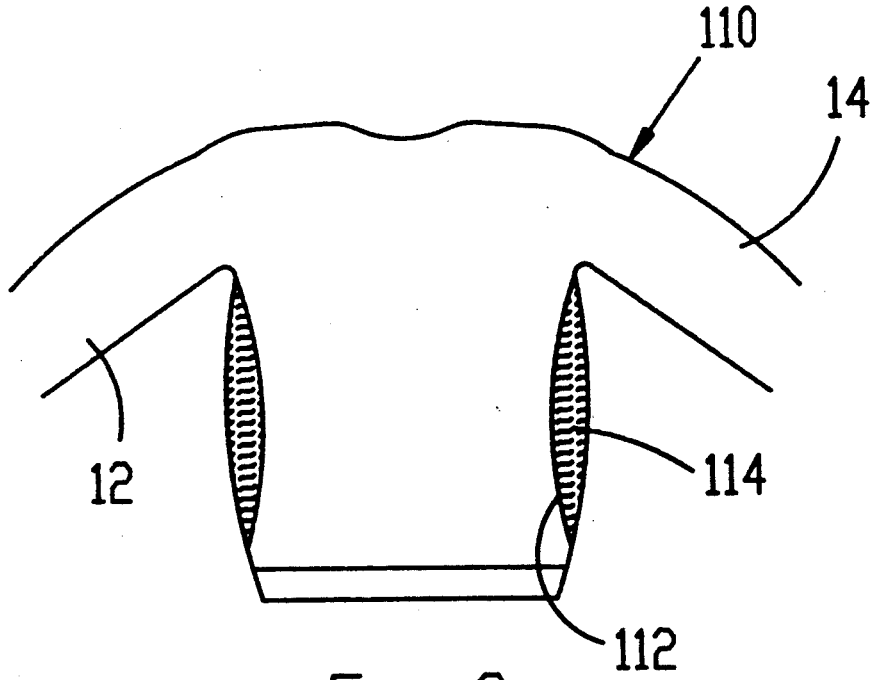
FIG. 8 is a rear elevational view of a modified form of garment in accordance with this invention showing a web in a stored condition.

FIG. 8 illustrates a variation of the invention wherein the garment 110 would include flaps or cut out portions 112 into which the web 114 may be inserted during periods of non use.

Figure 9:
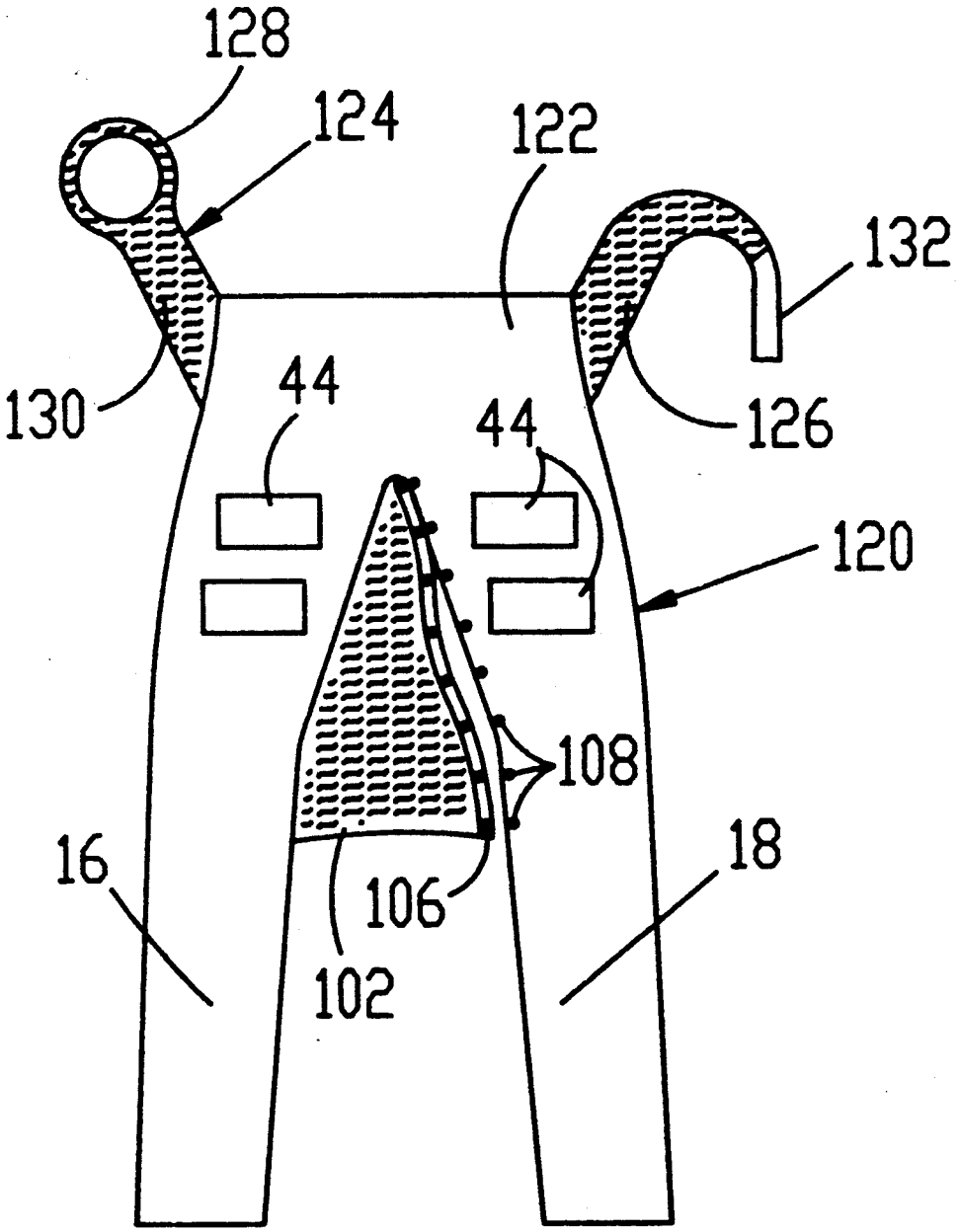
FIG. 9 is a front elevational view of still yet another form of garment showing variations of this invention.

FIG. 9 illustrates a variation wherein the garment 120 includes a web 102 between the legs as also shown in FIG. 7. In addition, however, the waist portion 122 of garment 120 includes a pair of webs 124,126 which would be attached to the arms or hands of the user. Web 124, for example, includes a loop 128 to which the arm or hand would be inserted. The loop would thus represent a portion of the garment worn on the arm interconnected to waist area 122 by the intermediate portion 130 which functions as the web per se. The web 126 shown in FIG. 9 terminates in a handle portion 132 which could be held by the user's hands during the exercise program.

It is to be understood that as used herein the term garment is meant to be used in its broadest sense. In this respect, in order to practice the invention it is necessary to provide two spaced areas of attachment for an interconnecting web. One of the areas of attachment should be to a limb, namely the arm or leg and the other area of attachment should be to some other part of the body, such as the torso or another arm or another leg. The portion of the garment which is on the body of the user, including the arm or leg may be of conventional garment construction, such as a shirt or pants or may be a more simplified construction, such as a band or belt worn on selected locations of the user where it is desired to attach the web. For example, the web may be connected to a wrist band and to a waist band or belt. It is preferable that the web extend to at least the joint or therebeyond to permit a greater extension when the limb is in motion. In this respect, if, for example, if the web were located solely in the armpit or crotch area there would not be as great an extension during the normal arm or leg movements.

It is also to be understood that while the invention has been specifically illustrated and described in connection with providing resistance between an arm and the body or between two legs, the invention may also be practiced by mounting the web between an arm and a leg or between both arms.

What is claimed is:

1. An exercise garment for supplementing a leg movement exercise program, comprising a lower body trunk portion having a trunk section and two leg sections, each of said leg sections extending to at least about the knees, said leg sections being joined to a crotch portion of said trunk section, a web connected to and spanning the space between said leg sections, said web generally extending from about the knee portion of each of said leg sections toward said crotch portion, and at least one of said web and said leg sections being made of a stretchable, resilient material for creating resistance to the movement of the legs selectively past each other during an exercise program whereby said material may stretch during the movement of the legs away from each other and said material returns toward its unstretched condition when the legs move toward each other.

2. The garment of claim 1 wherein said web is detachable from at least one of said leg sections.

3. The garment of claim 2 wherein said web is permanently fixed to the other of said leg sections, and said web being mounted to said garment during periods of non-use.

4. The garment of claim 2 wherein said trunk portion includes a cut out whereby at least a portion of said web may be inserted into said garment through said cut out during periods of non-use.

5. The garment of claim 2 wherein said web is fixedly connected to the other of said web sections, and said web being wrapped around said garment during periods of non-use.

6. The garment of claim 1 wherein said web is in the form of a panel.

7. The garment of claim 1 wherein said web is in the form of a plurality of spaced cords or straps.

8. The garment of claim 1 wherein said trunk portion includes at least one pocket into which weights may be insert, and a weight in at least one pocket.

9. The garment of claim 1 including a strap attached to said trunk portion, and said strap having a free end which is adapted to be worn on an arm.

10. The garment of claim 9 wherein one of said straps is provided on each side of said trunk portion.

11. The garment of claim 1 wherein said body portion is made of said stretchable, resilient material.

12. The garment of claim 11 wherein said web portion is also made of a stretchable, resilient material.

13. The garment of claim 1 wherein said web portion is made of said stretchable, resilient material.

14. The garment of claim 1 wherein an upper body portion is secured to said lower body portion to form a full body portion having a pair of sleeves and a pair of legs.

15. The garment of claim 14 wherein each of said sleeves is connected to said upper body portion by one of said webs.

16. The garment of claim 1 wherein said web is in the form of a solid panel.

17. In a method of performing an exercise program wherein the user does a primary exercise involving the repeated back and forth limb movement of the arms, the improvement being in that the user wears a garment having a first connecting section on the moving limb and having a second connecting section on the trunk of the user's body at a location remote from the armpit, providing a web which spans and is connected to the first and second connecting sections with at least one of the web and connecting sections being made of a stretchable and resilient material, providing resistance to the moving limb by the stretchable material stretching and resisting the movement of the limb when the connecting sections are relatively moved away from each other, providing the resistance along a length of the moving limb directly across the space to the trunk of the user's body, and returning the stretchable material toward its unstretched condition when the connecting sections are relatively moved toward each other, and repeating the stretching and returning of the stretchable material throughout the repeated back and forth limb movements.

18. In the method of claim 17 wherein the web has a pair of edges connected to the connecting sections, and detachably mounting at least one of the edges to its connecting section.

19. In the method of claim 18 including detachably mounting both of the edges to their connecting sections.

20. In the method of claim 18 including non-detachably mounting one of the edges, and mounting the web to the garment during periods of non-use.

21. In the method of claim 20 wherein the web is wrapped around the garment during periods of non-use.

22. In the method of claim 17 including inserting weights into pockets in the garment.

23. In the method of claim 17 wherein the web is made of the stretchable, resilient material.

24. In a method of performing an exercise program wherein the user does a primary exercise involving the repeated back and forth limb movement of the arms or legs, the improvement being in that the user wears a garment having a first connecting section on the moving limb and having a second connecting section on another part of the user's body, providing a web which spans and is connected to the first and second connecting sections with at least one of the web and connecting sections being made of a stretchable and resilient material, providing resistance to the moving limb by the stretchable material stretching and resisting the movement of the limb when the connecting sections are relatively moved away from each other, returning the stretchable material toward its unstretched condition when the garment including sleeves and an upper trunk portion and the web is connected to and spans the space between one of the sleeves and the upper trunk portion, and the limb movement including swinging the arms.

25. In the method of claim 24 wherein a web is connected to and spans the space between each of the sleeves and the upper trunk portion.

26. In the method of claim 25 wherein the garment includes a lower trunk portion and leg sections and a web is connected to and spans the space between the leg sections, and the limb movement includes moving the legs selectively past each other.

27. An exercise garment for supplementing an arm movement exercise program, comprising an upper body trunk portion for being worn on at least a portion of the upper body of the trunk of the user, a limb portion for being worn on the arm of the user, said limb portion including a joint portion for being at about the elbow of the arm of the user and said limb portion including an armpit portion, a web connected to said limb portion at at least two spaced locations between said joint portion and said armpit portion, said web spanning across and being connected to said trunk portion at a location remote from said armpit portion, and said web being made entirely of a stretchable, resilient material for creating resistance to the movement of the arm away from the trunk during an exercise program whereby said material may repeatedly stretch during the movement of the arm away from the trunk and said material repeatedly returns toward its unstretched condition when the arm moves toward the trunk.

28. The garment of claim 27, wherein said web is detachable from at least one of said limb and trunk portions.

29. The garment of claim 27 wherein said garment includes at least one pocket into which a weight may be inserted.

30. The garment of claim 3 wherein said web is wrapped around said other of said leg sections during periods of non-use.

31. In a method of performing an exercise program wherein the user does a primary exercise involving the repeated back and forth movement of the user's legs, the improvement being in that the user wears a garment having a first connecting section on one leg and having a second connecting section on the other leg, providing a web which spans and is connected to the first and second connecting sections with at least one of the web and connecting sections being made of a stretchable and resilient material, providing resistance to the moving legs by the stretchable material stretching and resisting the movement of the legs when the connecting sections are relatively moved away from each other, providing the resistance along a length of the moving legs directly across the space between the legs, and returning the stretchable material toward its unstretched condition when the connecting sections are relatively moved toward each other, and repeating the stretching and returning of the stretchable material throughout the repeated back and forth leg movements.

32. The garment of claim 27 wherein said web is in the form of a plurality of spaced cords or straps.

* * * * *